US006082283A

United States Patent [19]

Parker

[11] Patent Number: 6,082,283

[45] Date of Patent: Jul. 4, 2000

[54] MARINE MOORING SYSTEM

[75] Inventor: Graham Parker, Aberdeen, United Kingdom

[73] Assignee: Coflexip Stena Offshore Limited, United Kingdom

[21] Appl. No.: 09/284,303

[22] PCT Filed: Oct. 8, 1997

[86] PCT No.: PCT/GB97/02752

§ 371 Date: Apr. 9, 1999

§ 102(e) Date: Apr. 9, 1999

[87] PCT Pub. No.: WO98/15449

PCT Pub. Date: Apr. 16, 1998

[30] Foreign Application Priority Data

Oct. 9, 1996 [GB] United Kingdom ..... 9621031

[51] Int. Cl.[7] ..... B63B 21/00

[52] U.S. Cl. ..... 114/230.21; 441/3

[58] Field of Search ..... 114/206, 230.21, 114/293; 441/3–5

[56] References Cited

U.S. PATENT DOCUMENTS

| | | | |
|---|---|---|---|
| 3,248,937 | 5/1966 | Vincent | 73/141 |
| 3,880,105 | 4/1975 | Bryant | 114/206 |
| 5,284,452 | 2/1994 | Corona | 441/3 |

FOREIGN PATENT DOCUMENTS

| | | |
|---|---|---|
| 0796784 | 9/1997 | European Pat. Off. . |
| 204450 | 11/1983 | Germany . |
| 2269351 | 2/1994 | United Kingdom . |
| 97/30887 | 8/1997 | WIPO . |

*Primary Examiner*—Jesus D. Sotelo

*Attorney, Agent, or Firm*—Ostrolenk, Faber, Gerb & Soffen, LLP

[57] ABSTRACT

Mooring apparatus and method of use thereof, for marine vessels, comprising a subsea anchor (12) such as a suction pile (14A), and including a swivel (16) to which at least one mooring line (24) is connected, the other end of the mooring line being adapted for connection to the bow mooring apparatus of a marine vessel (22) such as a conventional tanker. The mooring line (24) includes a load cell for measuring tension applied to the line by reverse thrust of the vessel. Signals from the load cell are transmitted from the bow of the vessel to the bridge (40), enabling manual, automatic or semi-automatic control of the applied tension. In use, the mooring line is maintained under tension such that the vessel may weathervane around the swivel. The system may be employed as part of a subsea fluid product export system for offloading the product to a tanker moored using the system, employing a flexible riser (20) having its lower end connected to a subsea product source and its upper end connected to the fluid manifold of the tanker via a floating hose assembly (34).

22 Claims, 2 Drawing Sheets

MARINE MOORING SYSTEM

Figure 1:
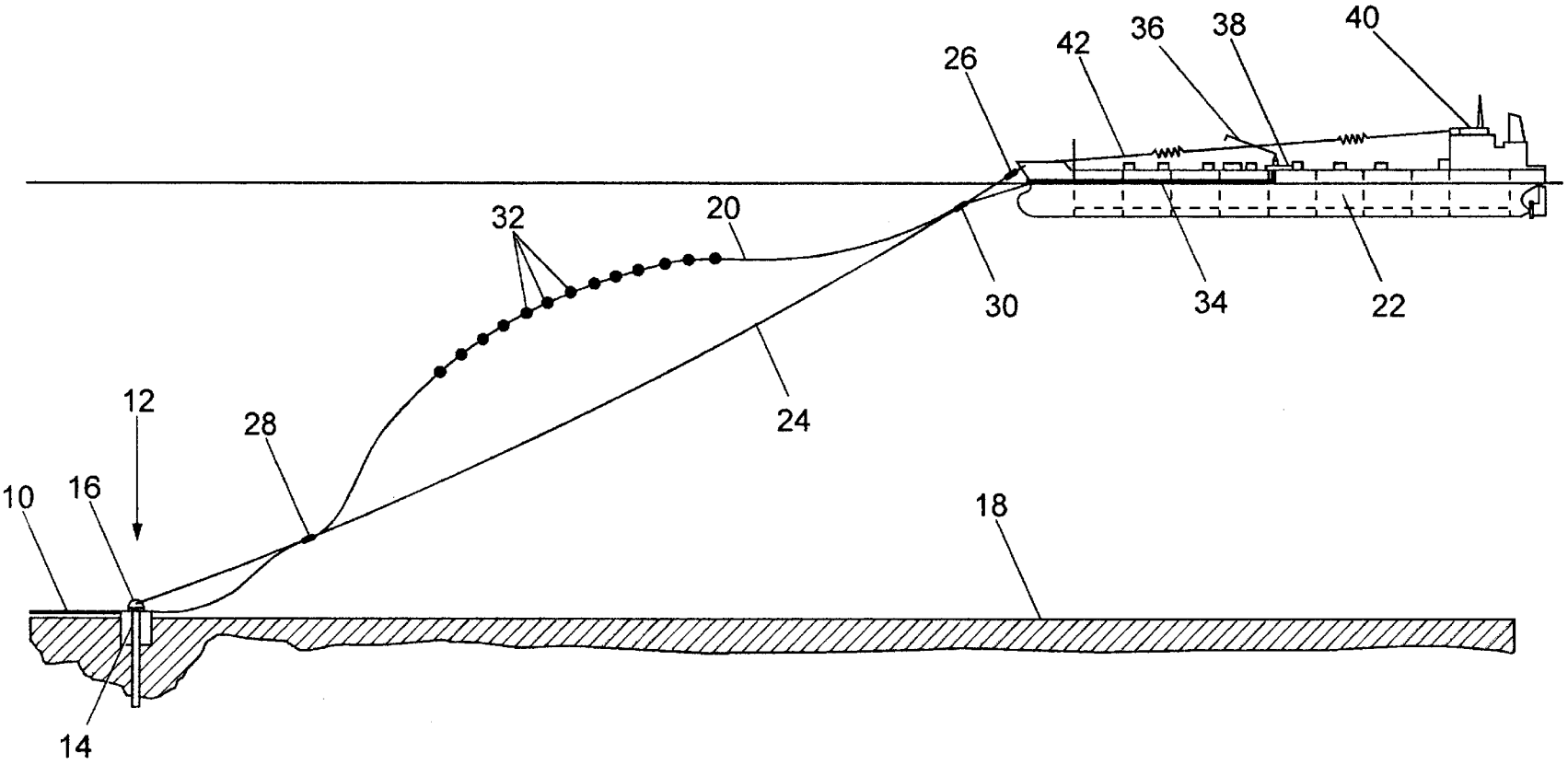

The present invention relates to improved methods and apparatus for the mooring of marine vessels. The invention is particularly, but not exclusively, concerned with offshore mooring systems for use in recovering fluid products (particularly hydrocarbon products such as oil and gas) from an offshore, subsea product source. The subsea product source is typically a subsea pipeline terminal, but could be a subsea wellhead, storage facility or the like. The invention might also find application in other situations where a tanker or the like is required to be moored reliably away from conventional mooring facilities, for handling other types of fluids such as water, liquid or gaseous chemicals, or for management of power supplies directed to or from the seabed, or simply for mooring large vessels.

In accordance with a first aspect of the invention, there is provided apparatus for mooring a marine vessel comprising: a subsea mooring assembly including anchor means for anchoring the assembly directly or indirectly to the seabed and including swivel means adapted for rotation about a substantially vertical axis; and at least one mooring line having a first end connected to said swivel and having a second end adapted to be connected, in use, to a marine vessel.

Preferably, the apparatus includes sensor means adapted to monitor tension applied to said mooring line. The apparatus preferably further includes transmitter means for transmitting signals from said sensor means and receiver means adapted to be located on the vessel, in use, for receiving said signals.

Preferably, said anchor means comprises an anchor pile, said swivel being secured to an upper end of said pile. Alternatively, said anchoring means comprises a subsea installation which is itself adapted to be anchored to the seabed. In a further alternative embodiment, said swivel is mounted on a buoyant body and said anchor means is secured to said buoyant body and adapted to maintain said buoyant body in a submerged condition at a predetermined height above the seabed, in use.

Preferably, the second end of said mooring line is connected to buoyancy means.

The apparatus preferably further includes a flexible riser conduit having a first end adapted to be connected a subsea source of a fluid product. Preferably also, said riser is coupled to said mooring line at at least two points between the first and second ends of said mooring line, and may be provided with buoyancy means between said two points.

Preferably, said riser has a second end adapted to be connected to a floating hose assembly.

In accordance with a second aspect of the invention, there is provided a method for mooring a marine vessel using apparatus in accordance with the first aspect of the invention, comprising securing the second end of said mooring line to the bow of said vessel and applying reverse thrust to said vessel so as to place said mooring line under tension.

Preferably also, the method includes monitoring the tension applied to the mooring line and varying the thrust applied to the vessel in order to maintain a substantially constant, predetermined tension on said mooring line.

Preferably, the method further comprises connecting said riser to a fluid manifold of fluid storage means located on the vessel, via said floating hose assembly.

The invention enables the use of a standard tanker vessel which is connected to the mooring line by means of its standard bow mooring equipment, or with minimal modification or upgrading of its bow mooring equipment. In applications involving the recovery of a fluid from a subsea source, this may be done via the standard midships manifold of the vessel. The floating hose assembly employed for this purpose may also be of standard type. The apparatus of the invention is relatively simple compared with existing mooring systems of equivalent functionality, and the present system avoids the need for specially adapted vessels, requiring, at most, minimal modification of standard vessels.

Figure 2:
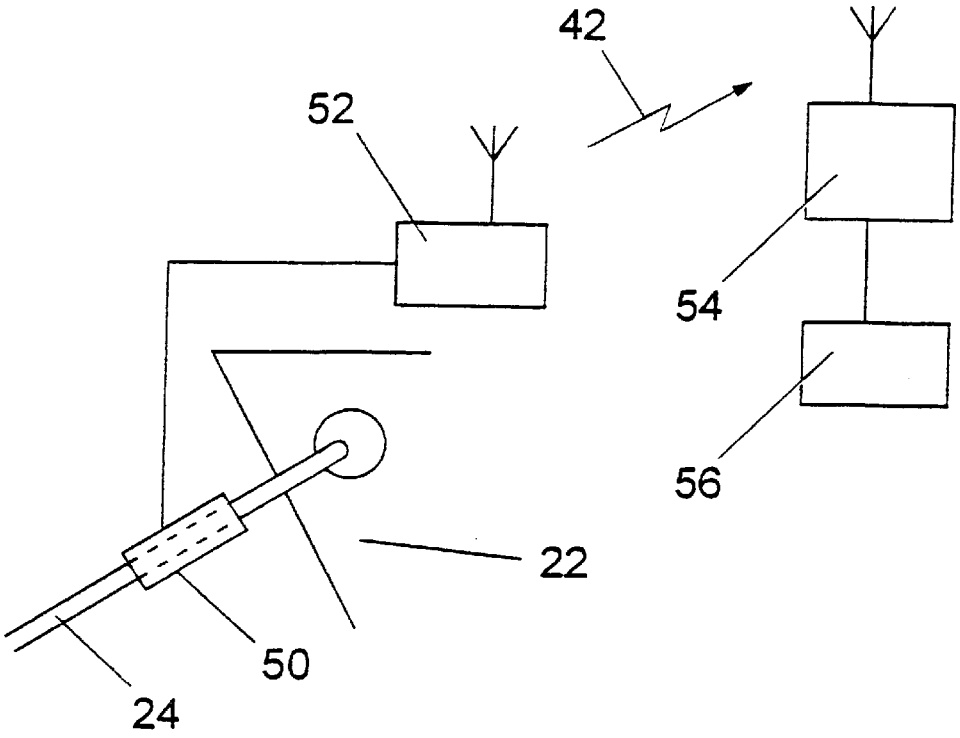
Figure 3:
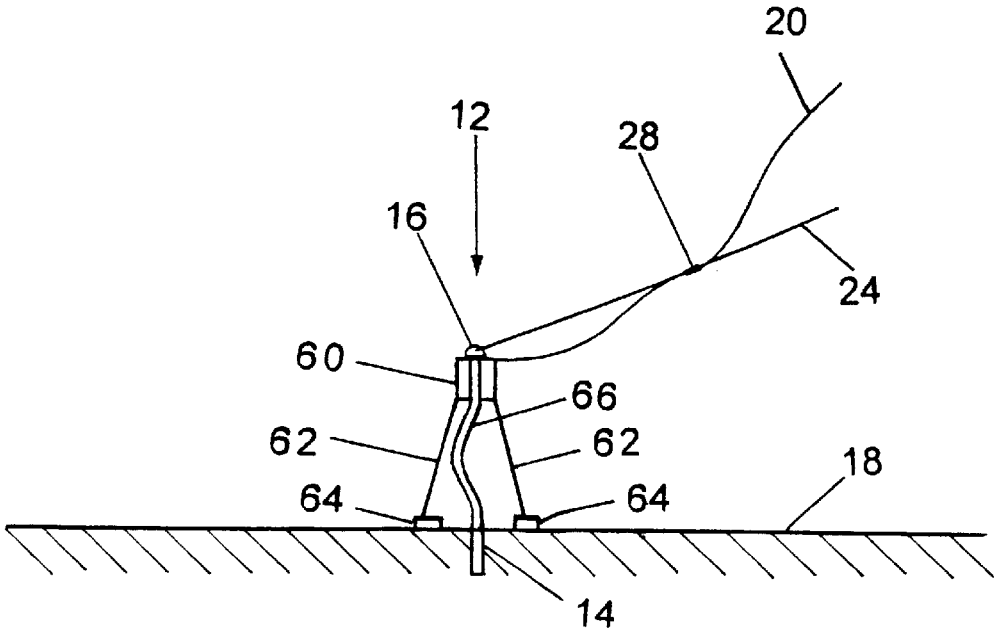

Embodiments of the invention will now be described, by way of example only, with reference to the accompanying drawings, in which FIG. 1 is a schematic illustration of a mooring system embodying the invention;

FIG. 2 is a schematic illustration of a tension monitoring system forming part of the system of FIG. 1; and FIG. 3 is a schematic illustration of an alternative embodiment of a mooring system in accordance with the invention.

Referring now to the drawing, a subsea pipeline 10 for transporting hydrocarbon products terminates at a subsea mooring assembly 12 in accordance with the invention. In this example, the mooring assembly 12 comprises an anchor pile 14 having a mooring swivel 16 mounted at its uppermost end, above the seabed 18. The pile 14 may, for example, be a conventional tubular pile or may be of the suction type. The axis of rotation of the swivel 16 is substantially vertical.

The product line 10 is terminated at the mooring assembly 12 by any suitable means, with a through-connection to a flexible riser conduit 20 by means of which the product may be conveyed to the water surface for loading into a tanker vessel 22 which is moored to the mooring assembly 12 by means of a mooring line 24. The fluid path may extend through the swivel body, so that the riser 20 may rotate freely with the rotary part of the swivel. The swivel might be configured so as to provide multiple fluid paths from multiple subsea conduits to multiple riser conduits. The upper end of the mooring line 24 is connected to a buoy 26, by means of which the end of the line 24 is supported at the water surface when not in use, for recovery by the vessel 22 when required. The buoy 26 is adapted to be picked up and connected to the conventional (or suitably reinforced) bow mooring equipment of the vessel.

The connection of the buoy to the vessel mooring equipment includes an in-line load cell (50, FIG. 2), enabling the tension on the mooring line 24 to be monitored, as shall be described further below.

The riser 20 is coupled to the mooring line 24 at a first point relatively close to the mooring assembly 16 and at a second point relatively close to the buoy 26 by means of connector collars 28 and 30, the length of the riser 20 intermediate the connector collars 28 and 30 being fitted with buoyancy collars 32, as is well known in the art. The upper end of the riser 20 is connected to a floating hose 34, which may be of conventional type as is also well known in the art. The floating hose 34 is adapted to be picked up by a conventional midships derrick 36 mounted on the tanker 22 for connection to the standard midships manifold 38 to enable off-loading of the product to (or, depending on the application, from) the tanker 22.

The system further includes an arrangement for monitoring the tension on the mooring line 24, as illustrated schematically in FIG. 2. This arrangement includes the load cell 50, which generates a signal representative of the tension on the mooring line 24. The signal generated by the load cell 50 is passed to a portable load monitoring transmitter unit 52 mounted adjacent the bow of the vessel, which transmits the signal, or a different signal derived from the load cell signal, to a portable load cell monitoring receiver unit 54 mounted on the bridge of the vessel. The transmission of the signals from the bow to the bridge is preferably by radio link 42. Other wireless electromagnetic transmission means could be used if appropriate. Obviously, a cable connection or the like could also be used, but will generally be less convenient in practice. The transmitter and receiver units 52 and 54 are preferably constructed so as to be readily portable between different vessels. The load cell 50 may remain installed on the mooring line when not in use, or may also be portable.

In use of the mooring system, the vessel 22 picks up and connects to the mooring line 24 and to the floating hose 34. The vessel 22 then stands off from the subsea mooring point, using slow reverse thrust to apply tension to the mooring line 24. The line tension may be controlled dynamically using load signals from the in-line load cell 50, the load signals being transmitted from the transmitter unit 52 at the bow of the vessel to the receiver unit 54 at the bridge 40 of the vessel. The riser 20 has a greater overall length than the mooring line 24, a degree of slack being provided in the riser 20 between the mooring assembly 12 and the lower connector collar 28 and between the connector collars 28 and 30, so that the tension in the mooring line 24 is not transferred to the riser 20.

With the mooring line 24 under controlled tension, the vessel may weathervane around the axis of the swivel 16, whether under the influence of environmental conditions (wind and/or sea movements) or under the control of the vessel 22 (by means of rudder deflections), according to the judgement of the vessel crew.

By way of example, the mooring line 24 might be a 192 mm diameter polyester rope, and the load bearings of the swivel 16 may utilise water-lubricated, sintered-bronze metal surfaces. The receiver unit 54 may include audible and/or visible alarm means, for prompting the crew on the bridge to take appropriate action so as to maintain the tension on the mooring line within predetermined limits. Alternatively or additionally, the receiver unit might be connected to an automatic or semi-automatic control system 56, for controlling the thrust, heading etc. of the vessel so as to maintain the tension within said limits. It will be understood that the nature of the load monitoring and signal processing and transmission systems might vary widely, as will be apparent to those skilled in the relevant art.

It will be understood that, when used as part of a subsea product export system, the subsea mooring assembly might be mounted on, or associated with, subsea installations such as wellheads or manifolds, with or without connections to additional product lines leading from other subsea installations. In a possible variation, illustrated in FIG. 3 the swivel 16 might be mounted on a buoy 60, the buoy 60 being anchored to the seabed by means of cables 62 and piles 64 or the like, so as to be maintained at a predetermined height above the seabed 18 and below the water surface. In this case, the product source would be connected to the buoy 60 by means of a flexible conduit 66.

The arrangement of the subsea swivel and mooring line in combination with a simple, portable tension monitoring system, and its method of use, provides the basis for a mooring system having a wide variety of possible uses, including subsea product export, but also including general mooring applications, or the handling of other products for other purposes. It enables safe and reliable mooring of large vessels such as tankers in locations without conventional mooring facilities, whilst being substantially less complex than existing systems having equivalent functionality and which also require substantial modifications of vessels and/or the use of more sophisticated vessels.

In particular, the system does away with the requirement for a vessel with dynamic positioning capability (i.e. multiple, variable azimuth, computer controlled thrusters), and also eleiminates the need for the vessel to be maintained under constant, active, manual control. With the vessel under slow reverse thrust so as to tension the mooring line, the vessel will weathervane around the subsea swivel, safely and with minimal requirement for manual intervention.

Improvements or modifications may be incorporated without departing from the scope of the invention.

What is claimed is:

1. Apparatus for mooring a marine vessel comprising: a subsea mooring assembly including anchor means for anchoring the assembly to the seabed and including swivel means adapted for rotation about a substantially vertical axis; and at least one mooring line having a first end connected to said swivel and having a second end adapted to be connected, in use, to the bow of a marine vessel; and further including a flexible riser conduit having a first end adapted to be connected to a subsea source of a fluid product; wherein said riser is coupled to said mooring line at at least two points between the first and second ends of said mooring line.

2. Apparatus as claimed in claim 1, further including sensor means adapted to monitor tension applied to said mooring line.

3. Apparatus as claimed in claim 2, further including transmitter means for transmitting signals from said sensor means and receiver means adapted to be located on the vessel, in use, for receiving said signals.

4. Apparatus as claimed in claim 3, wherein said transmitter means is adapted to be located adjacent the bow of the vessel.

5. Apparatus as claimed in claim 3, wherein said receiver means is adapted to be located on the bridge of said vessel.

6. Apparatus as claimed in claim 3, wherein said receiver means includes means for generating output signals when the tension on said mooring line falls outwith predetermined limits.

7. Apparatus as claimed in claim 6, wherein said output signals include audible alarm signals.

8. Apparatus as claimed in claim 6, wherein said signals include control signals.

9. Apparatus as claimed in claim 6, wherein said output signals include visual alarm signals.

10. Apparatus as claimed in claim 1, wherein said sensor means is adapted to monitor tension applied at said second end of said mooring line, in use of the apparatus, by reverse thrust of said marine vessel.

11. Apparatus as claimed in claim 10, wherein said sensor means is located at said second end of said mooring line.

12. Apparatus as claimed in claim 10, wherein said sensor means is located adjacent to said second end of said mooring line.

13. Apparatus as claimed in claim 1, wherein said anchor means comprises an anchor pile, said swivel being secured to an upper end of said pile.

14. Apparatus as claimed in claim 1, wherein, said anchoring means comprises a subsea installation which is adapted to be anchored to the seabed.

15. Apparatus as claimed in claim 1, wherein said swivel is mounted on a buoyant body and said anchor means is secured to said buoyant body and adapted to maintain said buoyant body in a submerged condition at a predetermined height above the seabed, in use.

16. Apparatus as claimed in claim 1, wherein the second end of said mooring line is connected to buoyancy means.

17. Apparatus as claimed in claim 1, wherein said riser is provided with buoyancy means between said two points.

18. Apparatus as claimed in claim 1, wherein said riser has a second end adapted to be connected to a floating hose assembly.

19. Apparatus as claimed in claim 1, wherein said anchor means includes fluid conduit means to which said first end of said riser is connected, in use of the apparatus.

20. A method for mooring a marine vessel using apparatus for mooring a marine vessel comprising: a subsea mooring assembly including anchor means for anchoring the assembly to the seabed and including swivel means adapted for rotation about a substantially vertical axis; and at least one mooring line having a first end connected to said swivel and having a second end adapted to be connected, in use, to the bow of a marine vessel; the method comprising securing the second end of said mooring line to the bow of said vessel and applying reverse thrust to said vessel so as to place said mooring line under tension.

21. The method of claim 20, further including: monitoring the tension applied to the mooring line and varying the thrust applied to the vessel in order to maintain the tension within predetermined limits.

22. The method of claim 20, wherein said apparatus further includes a flexible riser conduit having a first end adapted to be connected a subsea source of a fluid product; the method further comprising connecting said riser to a fluid manifold of fluid storage means located on the vessel, via a floating hose assembly.

* * * * *